US009527691B2

(12) United States Patent
Eoka et al.

(10) Patent No.: US 9,527,691 B2
(45) Date of Patent: Dec. 27, 2016

(54) PAPER DISCHARGING APPARATUS, PAPER DISCHARGING METHOD, IMAGE FORMING APPARATUS AND IMAGE FORMING METHOD

(71) Applicant: TOSHIBA TEC KABUSHIKI KAISHA, Shinagawa-ku, Tokyo (JP)

(72) Inventors: Kenji Eoka, Shizuoka (JP); Tsuyoshi Sanada, Singapore (SG)

(73) Assignee: TOSHIBA TEC KABUSHIKI KAISHA, Tokyo (JP)

( * ) Notice: Subject to any disclaimer, the term of this patent is extended or adjusted under 35 U.S.C. 154(b) by 127 days.

(21) Appl. No.: 14/557,702

(22) Filed: Dec. 2, 2014

(65) Prior Publication Data

US 2015/0108197 A1 Apr. 23, 2015

Related U.S. Application Data

(62) Division of application No. 13/539,723, filed on Jul. 2, 2012, now Pat. No. 8,925,432.

(30) Foreign Application Priority Data

Jul. 11, 2011 (JP) ..... 2011-153169

(51) Int. Cl.
*B26D 1/00* (2006.01)
*B26D 7/06* (2006.01)
(Continued)

(52) U.S. Cl.
CPC ..... *B65H 20/02* (2013.01); *B26D 7/025* (2013.01); *B41J 13/106* (2013.01); *B65H 35/04* (2013.01);
(Continued)

(58) Field of Classification Search
CPC . B65H 20/02; B65H 35/04; B65H 2701/1311; B65H 2301/121; B65H 2301/51212; B65H 20/03; B65H 2513/512; B65H 2404/1441; B65H 2408/13; B65H 2601/325; B65H 2301/543; B65H 2801/12; B41J 13/106; B26D 7/025; B26D 2007/005; Y10T 83/04; Y10T 83/4526; Y10T 83/2196; Y10T 83/207; Y10T 83/4594
(Continued)

(56) References Cited

U.S. PATENT DOCUMENTS 1,930,447 A 5/1929 Borchers
3,937,112 A * 2/1976 Geeson ..... B21D 43/09 226/117
(Continued)

FOREIGN PATENT DOCUMENTS

JP 08-073095 3/1996

*Primary Examiner* — Ghassem Alie
*Assistant Examiner* — Bharat C Patel
(74) *Attorney, Agent, or Firm* — Amin, Turocy & Watson LLP

(57) ABSTRACT

A paper discharging apparatus comprises: a first conveying unit; a second conveying unit which includes a pinch roller and a feeding roller that are arranged closer to the downstream side; a movable mechanism which moves a surface part between a first position that the surface part is not contacted with the pinch roller and a second position that the surface part is contacted with the pinch roller through the paper so as to push the pinch roller; a control unit which moves the surface part to the second position, clamps the paper by the pinch roller and the surface part, and conveys the paper, thereby bending the paper, and which moves the surface part to the first position and clamps the paper by the pinch roller and the feeding roller, and rotates the feeding roller, thereby discharging the paper from the conveyance path.

6 Claims, 17 Drawing Sheets

(51) Int. Cl.

| | |
|---|---|
| ***B26D 5/20*** | (2006.01) |
| ***B65H 5/02*** | (2006.01) |
| ***B41J 11/00*** | (2006.01) |
| ***B41J 29/02*** | (2006.01) |
| ***B65H 20/02*** | (2006.01) |
| ***B65H 35/04*** | (2006.01) |
| ***B26D 7/02*** | (2006.01) |
| ***B41J 13/10*** | (2006.01) |
| *B65H 20/30* | (2006.01) |
| *B26D 7/00* | (2006.01) |

(52) U.S. Cl.
CPC ..... *B26D 2007/005* (2013.01); *B65H 20/30* (2013.01); *B65H 2301/121* (2013.01); *B65H 2301/51212* (2013.01); *B65H 2301/543* (2013.01); *B65H 2404/1441* (2013.01); *B65H 2408/13* (2013.01); *B65H 2511/22* (2013.01); *B65H 2513/512* (2013.01); *B65H 2601/325* (2013.01); *B65H 2701/1311* (2013.01); *B65H 2801/12* (2013.01); *Y10T 83/04* (2015.04); *Y10T 83/207* (2015.04); *Y10T 83/2196* (2015.04); *Y10T 83/4526* (2015.04); *Y10T 83/4594* (2015.04)

(58) Field of Classification Search
USPC ..... 83/235–236, 261–262, 282, 100–111; 400/693, 582; 271/274
See application file for complete search history.

(56) References Cited

U.S. PATENT DOCUMENTS

| | | | | |
|---|---|---|---|---|
| 4,151,004 | A | 4/1979 | Vukelic | |
| 4,223,882 | A | 9/1980 | Stocker | |
| 4,417,808 | A | 11/1983 | Kogane | |
| 4,926,727 | A | 5/1990 | Maeda | |
| 5,442,983 | A | 8/1995 | D'Angelo et al. | |
| 5,779,379 | A * | 7/1998 | Mason | B41J 11/70 101/228 |
| 5,826,474 | A | 10/1998 | Howard et al. | |
| RE36,112 | E * | 2/1999 | Hano | G03G 15/6523 399/385 |
| 5,954,438 | A * | 9/1999 | Klein | B41J 11/70 101/226 |
| 6,042,104 | A | 3/2000 | Nishikori et al. | |
| 6,056,460 | A * | 5/2000 | Suzuki | B65H 29/62 400/582 |
| 6,428,226 | B1 * | 8/2002 | Suzuki | B41J 13/106 400/619 |
| 6,533,478 | B1 | 3/2003 | Matsuyama | |
| RE38,092 | E * | 4/2003 | Yamada | B41J 2/01 242/530.4 |
| 6,543,761 | B2 * | 4/2003 | Endo | B65H 3/5223 271/110 |
| 6,674,035 | B2 * | 1/2004 | Ito | B65H 5/06 209/563 |
| 6,982,738 | B2 * | 1/2006 | Mogi | B41J 2/355 347/218 |
| 7,410,315 | B2 * | 8/2008 | Nakayama | B41J 2/325 347/104 |
| 7,874,752 | B2 * | 1/2011 | Kawabe | B41J 11/0095 347/108 |
| 8,066,278 | B2 | 11/2011 | Sanada et al. | |
| 8,132,812 | B2 * | 3/2012 | Tsusaka | B41J 13/03 271/274 |
| 8,152,294 | B2 * | 4/2012 | Katsuyama | B41J 2/17509 347/104 |
| 8,292,526 | B2 * | 10/2012 | Sakai | B41J 2/32 271/9.1 |
| 8,721,207 | B2 * | 5/2014 | Sekino | B41J 13/0036 271/188 |
| 2002/0020962 | A1 * | 2/2002 | Takeda | B41J 11/70 271/314 |
| 2004/0156665 | A1 * | 8/2004 | Ng | B65H 23/1888 400/578 |
| 2005/0168562 | A1 | 8/2005 | Imai | |
| 2005/0174383 | A1 | 8/2005 | Inoue | |
| 2005/0212892 | A1 | 9/2005 | Iso | |
| 2006/0115313 | A1 | 6/2006 | Shaw | |
| 2008/0202300 | A1 | 8/2008 | Steidinger et al. | |
| 2008/0219500 | A1 | 9/2008 | Silverbrook et al. | |
| 2009/0033733 | A1 | 2/2009 | Higashimoto et al. | |
| 2009/0189337 | A1 | 7/2009 | Yamamoto | |
| 2009/0190982 | A1 | 7/2009 | Yamamoto | |
| 2009/0244231 | A1 | 10/2009 | Tsuji et al. | |
| 2009/0245913 | A1 * | 10/2009 | Yamamoto | B26D 1/305 400/621 |
| 2009/0268007 | A1 * | 10/2009 | Sekino | B41J 3/60 347/218 |
| 2010/0186612 | A1 | 7/2010 | Sugiyama | |
| 2010/0296855 | A1 | 11/2010 | Hopkins et al. | |
| 2011/0293347 | A1 * | 12/2011 | Sekino | B41J 13/0009 400/582 |

* cited by examiner

PAPER DISCHARGING APPARATUS, PAPER DISCHARGING METHOD, IMAGE FORMING APPARATUS AND IMAGE FORMING METHOD

CROSS-REFERENCE TO RELATED APPLICATIONS

This application is a Division of application Ser. No. 13/539,723 filed Jul. 2, 2012, the entire contents of which are incorporated herein by reference.

This application is based upon and claims the benefit of priority from Japanese Patent Application No. 2011-153169, filed Jul. 11, 2011, the entire contents of which are incorporated herein by reference.

FIELD

Embodiments described herein relate to a paper discharging apparatus, a paper discharging method, an image forming apparatus and an image forming method.

BACKGROUND

At present, in an image forming apparatus, a printed paper is discharged through a conveyance path by a paper discharging function which is arranged at the rear part or section of the image forming apparatus. Then, the discharged paper can be taken by a user.

This paper discharging function is likely to lead to a problem that the paper is exposed to the outside before the print is completed and thus may be taken away by the user by mistake. Therefore, the image forming apparatus is expected to discharge a paper only after required processes, such as, e.g., printing and the like are completed.

DETAILED DESCRIPTION

According to one embodiment, a paper discharging apparatus, comprising: a paper conveyance path;

a first conveying unit configured to convey a paper along the conveyance path;

a second conveying unit including a pinch roller and a feeding roller that are arranged closer to the downstream side than the first conveying unit in the paper conveying direction, the pinch roller and the feeding roller clamping the paper therebetween and conveying the paper along the conveyance path;

a movable mechanism, including a surface part having a specified shape, moving the surface part between a first position that the surface part is not contacted with the pinch roller and a second position that the surface part is contacted with the pinch roller through the paper and pushes the pinch roller until the pinch roller is separated from the feeding roller; and a control unit configured to move the surface part to the second position by the movable mechanism, wherein the paper is clamped by the pinch roller and the surface part and the paper is bent through conveying the paper by the first conveying unit under this state, and to move the surface part to the first position by the movable mechanism, wherein the paper is clamped by the pinch roller and the feeding roller and the paper is discharged from the conveyance path by rotating the feeding roller under this state.

Embodiments of the present invention are described in detail below with reference to the accompanying drawings.

In the present embodiment, a receipt printer for issuing a receipt paper on which the various information relating to the account settlement of a business transaction is printed is exemplarily described as the image forming apparatus A. The elements of the image forming apparatus relating to the paper discharging constitute the paper discharging apparatus described in this embodiment.

Figure 1:
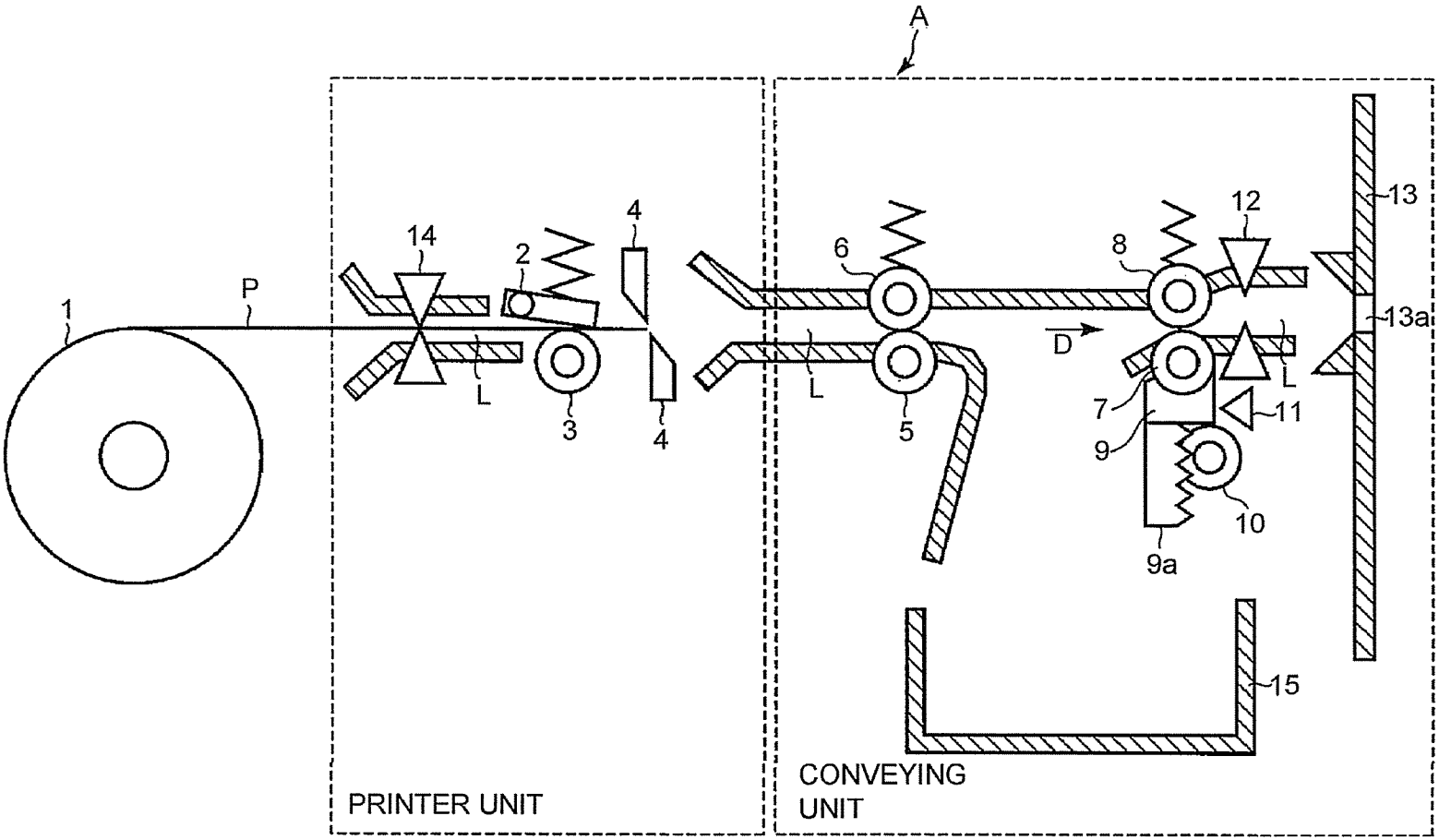
FIG. 1 is a sectional view showing a structural example of an image forming apparatus according to an embodiment.
Figure 2:
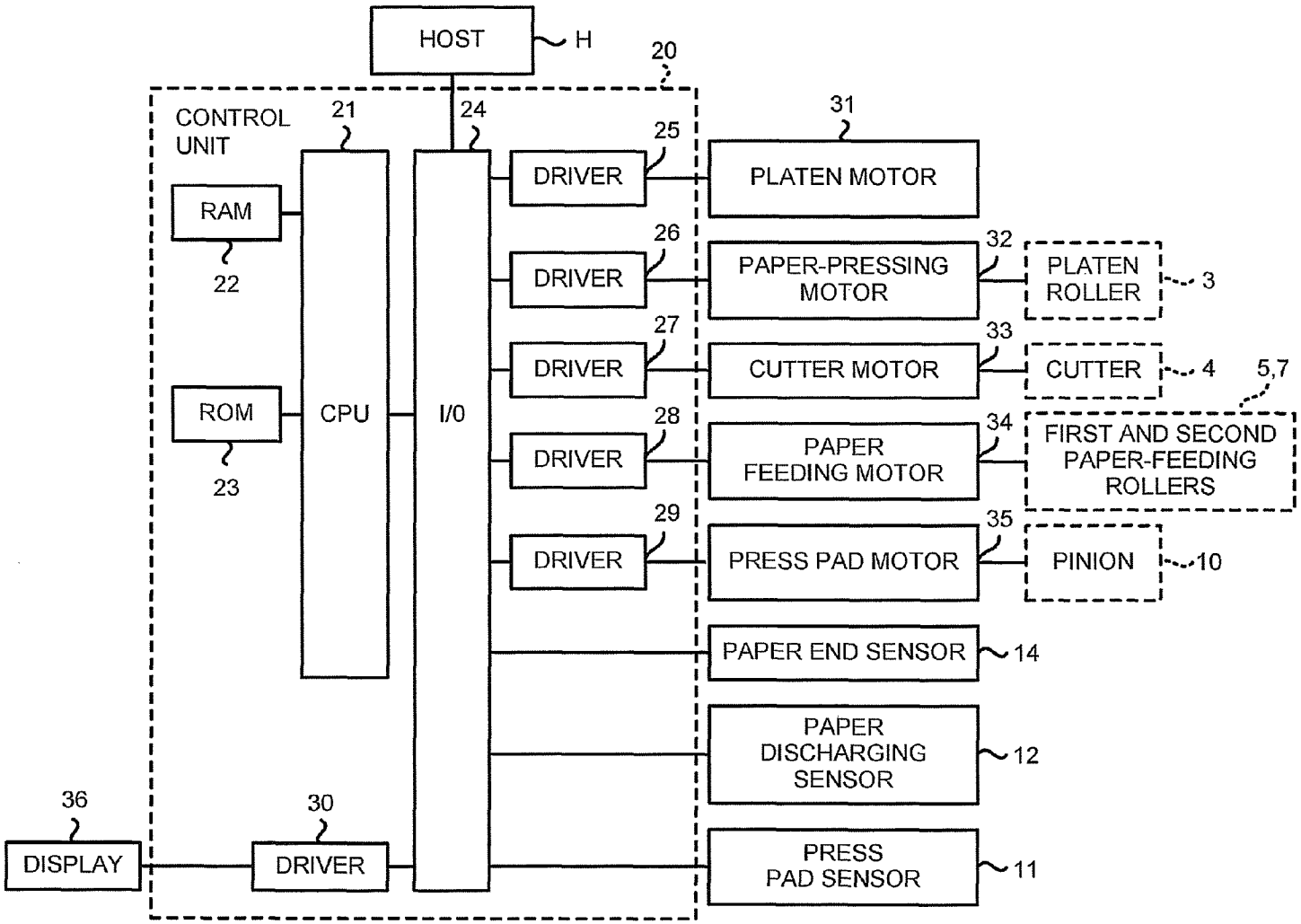
FIG. 2 is a block diagram showing an example of the image forming apparatus.

FIG. 1 is a sectional view showing a structural example of an image forming apparatus according to an embodiment, and FIG. 2 is a block diagram showing an example of the image forming apparatus.

As shown in FIG. 1, in the image forming apparatus A (or paper discharging apparatus), there is provided with a rolled paper 1 for providing a paper P to be used and a conveyance path L for conveying the paper P provided from the rolled paper 1 to the rear part or section of the image forming apparatus A. In addition, the image forming apparatus A is equipped with a printer unit which comprises, from the upstream side to the downstream side of the conveyance path L, a paper end sensor 14, a thermal printing head 2, a platen roller 3 and a cutter 4.

The paper end sensor 14 is a sensor for detecting, for example, optically, existence or absence of paper. Shortage of paper can be detected based on the detection result of the paper end sensor 14.

The thermal printing head 2 is applied with a force toward the platen roller 3 by an elastic component and is contacted with the platen roller 3 through the paper P. The platen roller 3 is driven by a platen motor 32 (refer to FIG. 2). The thermal printing head 2 is activated while the paper P is conveyed by the platen roller 3, thereby printing letters, images and the like on the paper P.

The cutter 4 is driven by a cutter motor 33 (refer to FIG. 2) to cut off the paper P.

The image forming apparatus A is also equipped with a conveying unit which comprises, along from the upstream side to the downstream side of the conveyance path L, a first feeding roller 5, a first pinch roller 6, a second feeding roller 7, a second pinch roller 8, a paper discharging sensor 12 and a housing 13 of the image forming apparatus on which a paper discharge port 13A is formed.

The first feeding roller 5 and the second feeding roller 7 are driven by a feeding motor 34 (refer to FIG. 2). The first pinch roller 6 and the second pinch roller 8 are respectively urged by an elastic component toward the first feeding roller 5 and the second feeding roller 7. The first feeding roller 5 and the first pinch roller 6 function as a first conveying unit in this embodiment to clamp the paper P conveyed along the conveyance path L from the head section of the image forming apparatus and to convey the paper P to the rear section of the image forming apparatus through the rotation of the first feeding roller 5. The second feeding roller 7 and the second pinch roller 8 function as a second conveying unit in this embodiment to clamp the paper P fed by the first feeding roller 5 and the first pinch roller 6 and to convey the paper P to the paper discharge port 13A through the rotation of the second feeding roller 7.

As shown in FIG. 1, the conveyance path L is downwards opened between a first position where the first feeding roller 5 and the first pinch roller 6 are provided and a second position where the second feeding roller 7 and the second pinch roller 8 are provided. A capture bin 15 is provided below the opened part of the conveyance path L to accommodate the printed paper P withdrawn by the operations described later into the image forming apparatus A.

A press pad 9 is arranged nearby the second feeding roller 7 and the second pinch roller 8. A rack component 9A having linear gears on one surface thereof is provided below the press pad 9. The linear gears of the rack component 9A are meshed with a pinion 10 driven by a press pad motor 35 (refer to FIG. 2), and the press pad 9 is lifted or lowered with the rotation of the pinion 10. Moreover, a press pad sensor 11 for detecting the position or lifted or lowered distance (amount) of the press pad 9 is provided nearby the press pad 9. The press pad 9, the rack component 9A and the pinion 10 constitute a movable mechanism.

The electrical components of the image forming apparatus (or the paper discharging apparatus in case that the thermal printing head 2 is not provided) described in this embodiment comprises, as shown in FIG. 2, a control unit 20 for controlling all the operations of the apparatus. The control unit 20 includes a CPU 21, a RAM 22, a ROM 23 and an interface 24 that are connected with the CPU 21. The RAM 22 and ROM 23 previously store control information, operation information, management information and control programs, and the interface 24 is connected with various drivers 25-30. The CPU 21 executes the control programs stored in the RAM 22 and the ROM 23 to realize operations or functions described later.

In addition to the CPU 21 and the drivers 25-30, the interface 24 is further connected with an external host computer H, the paper end sensor 14, the paper discharging sensor 12 and the press pad sensor 11.

The driver 25 is connected with the thermal printing head 2. The driver 26 is connected with the platen motor 32 which rotates the platen roller 3. The driver 27 is connected with the cutter motor 33 which rotates clockwise and anticlockwise to drive the cutter 4. The driver 28 is connected with the feeding motor 34 which is rotatable clockwise and anticlockwise to rotate the first feeding roller 5 and the second feeding roller 7. The driver 29 is connected with a press pad motor 35 which is rotatable clockwise and anticlockwise to rotate the pinion 10, and the driver 30 is connected with the display 36 on which various operation information and management information can be displayed.

The drivers 25-30 control the thermal printing head 31, the platen motor 32, the cutter motor 33, the feeding motor 34, the press pad motor 35 and the display 36, respectively.

An operation effect of the press pad 9 when the pad 9 goes up and down is explained below.

Figure 3:
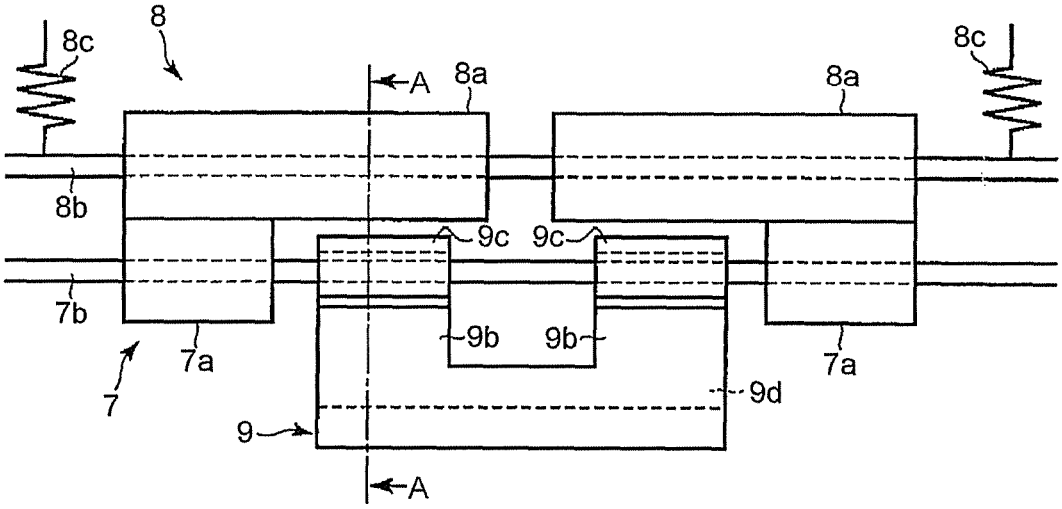
FIG. 3 is a schematic diagram showing a press pad located at a standby position in the image forming apparatus.
Figure 4:
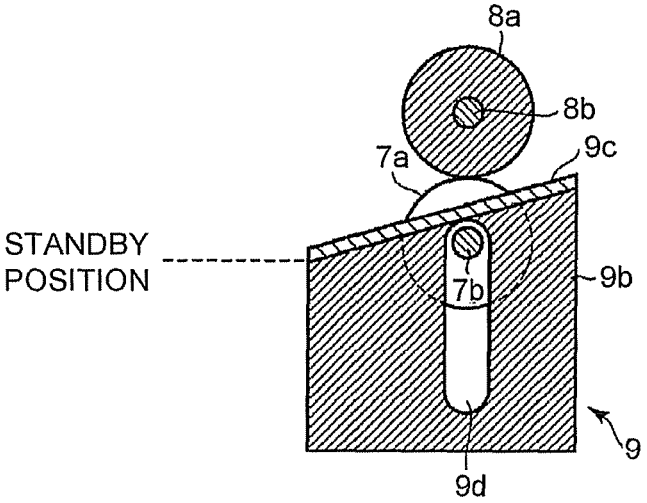
FIG. 4 is the sectional view taken on line A-A in FIG. 3.
Figure 5:
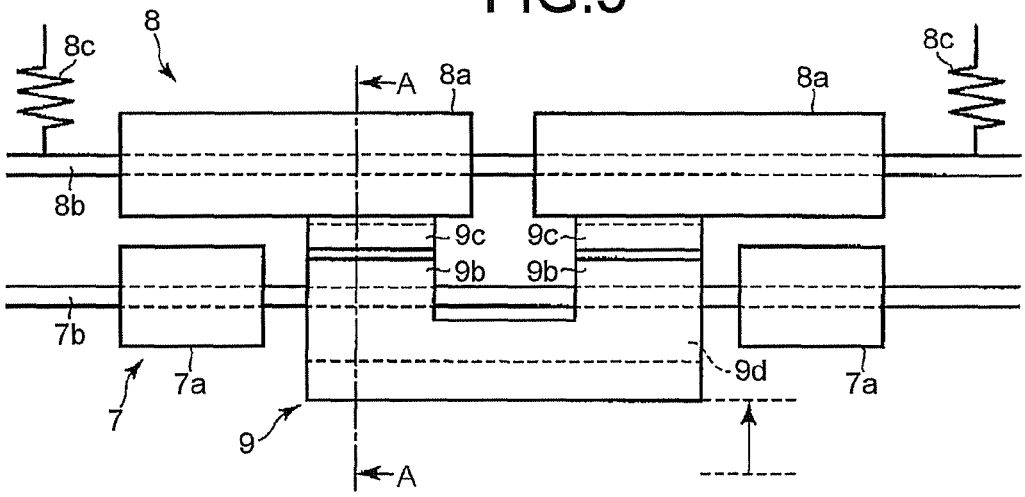
FIG. 5 is a schematic diagram showing a press pad located at a separate position in the image forming apparatus.
Figure 6:
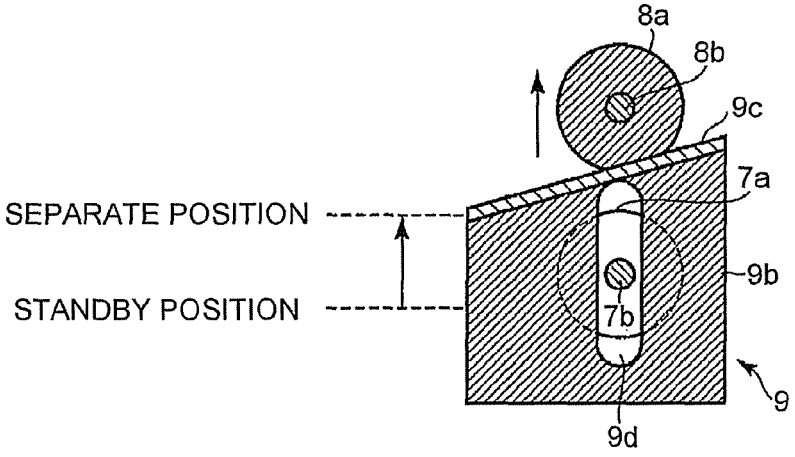
FIG. 6 is the sectional view taken on line A-A in FIG. 4.

FIG. 3 and FIG. 5 are schematic diagrams showing the press pad 9, the second feeding roller 7 and the second pinch roller 8 observed from the conveying direction of the paper P (the direction indicated by the arrow D in FIG. 1), and FIG. 4 and FIG. 6 are sectional views of the line A-A in FIG. 3 and FIG. 5. FIG. 3 and FIG. 5 show the press pad 9 at a standby position (starting position), and FIG. 4 and FIG. 6 show the press pad 9 lifted from the standby position.

As shown in FIG. 3, the feeding roller 7 is provided on a transmission shaft 7*b* on which a pair of cylindrical rollers 7A is rotationally supported and the pinch roller 8 is provided on a transmission shaft 7B that a pair of cylindrical rollers 8A is connected with the feeding motor 34. The transmission shafts 7B and 8B are arranged in a parallel manner, and the rollers 7A are shorter than the rollers 8A. The transmission shaft 8B is urged by, for example, a pair of elastic components 8C toward the feeding roller 7, thereby contacting the rollers 8A against the rollers 7A.

As shown in FIG. 3, the press pad 9 is provided between the pair of rollers 7A and is formed in a concaved shape. The upper surface 9C of left and right protrusion parts 9B of the press pad 9 is inclined towards the upstream side in the paper conveying direction, as shown in FIG. 4. The upper surface 9C is made from a material having a high friction against the paper P, such as EPDM (Ethylene-Contactylene-Diene Monomer rubber).

The press pad 9 has an elongated hole 9D, into which the transmission shaft 7B is inserted to prevent the transmission shaft 7B from interfering the elevation of the press pad 9.

The upper surface 9C of the press pad 9 is not contacted with the pinch roller 8 when the press pad 9 is at the standby position. On the contrary, when the press pad 9 is lifted from the standby position by the rack component 9A and the pinion 10, the upper surface 9C is contacted with the pinch roller 8, and the upper surface 9C presses the pinch roller 8 when the press pad 9 is further lifted, as shown in FIG. 5 and FIG. 6, whereby the elastic component 8 is compressed to lift the pinch roller. In this way, the feeding roller 7 is spaced away from the pinch roller 8. In the following description, the position of the lifted press pad 9 is referred to as a separate position.

(Operation)

Figure 14:
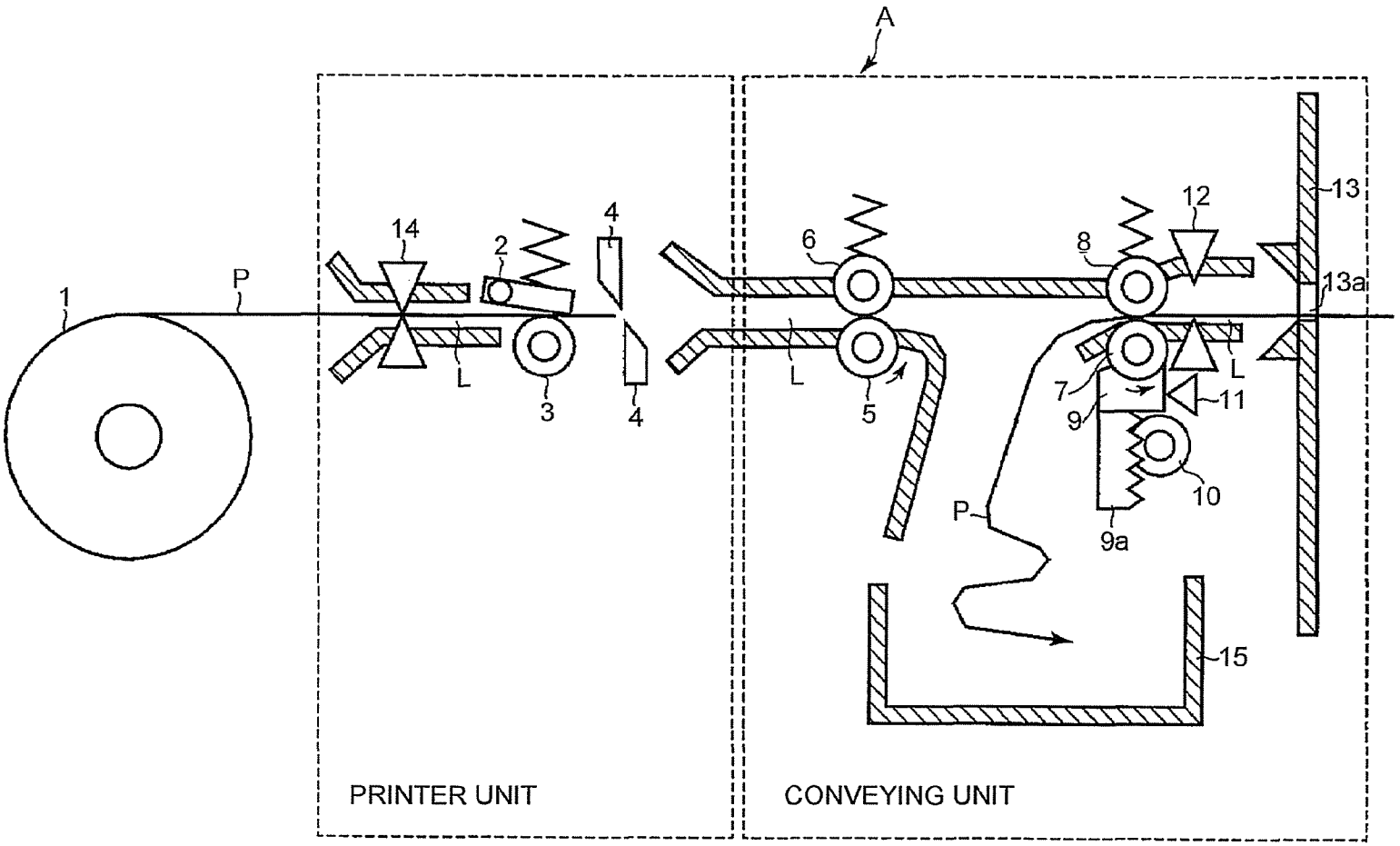
FIG. 14 is a sectional view showing the image forming apparatus into which paper is being withdrawn.
Figure 15:
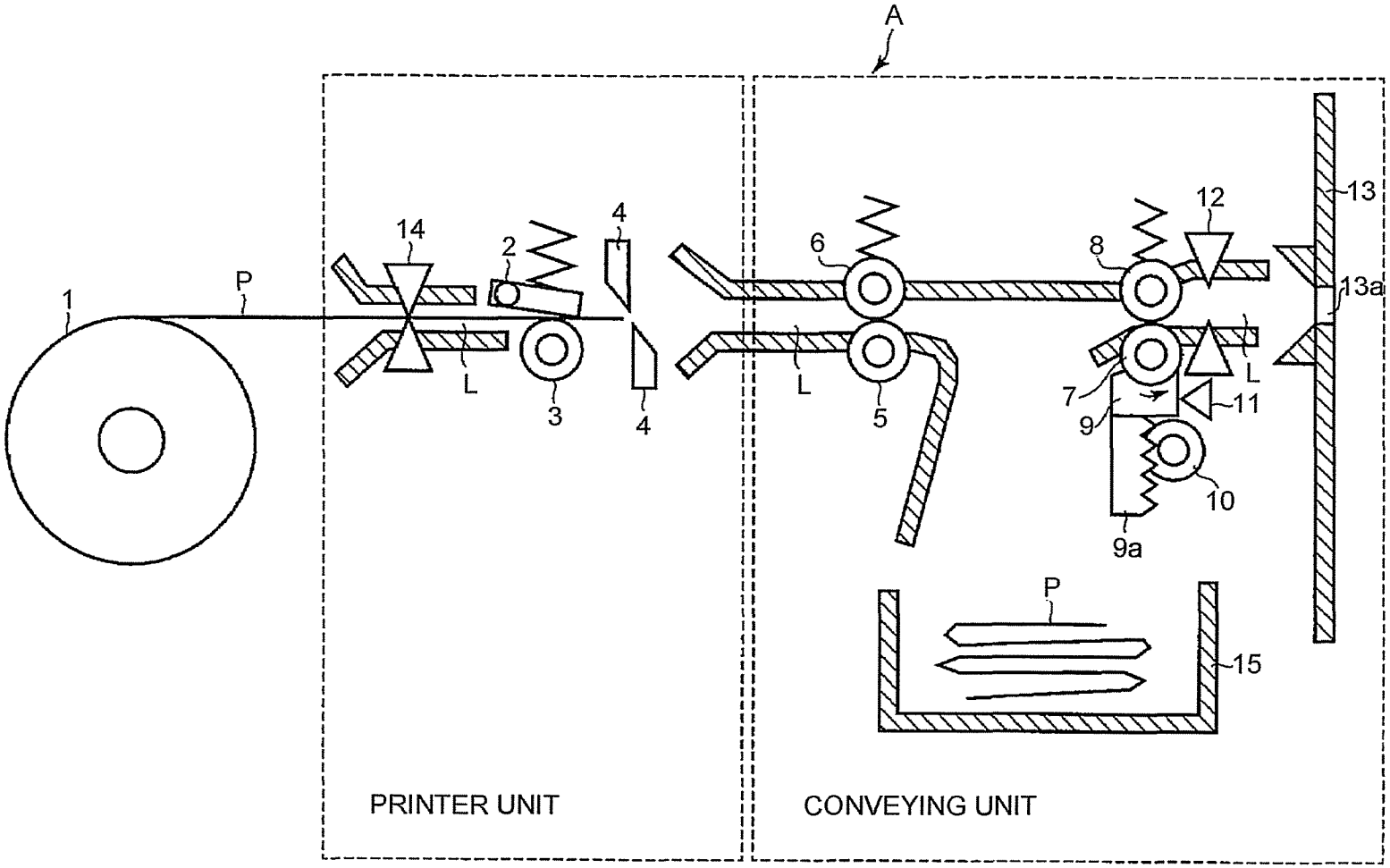
FIG. 15 is a sectional view showing the image forming apparatus in which paper is withdrawn.
Figure 16:
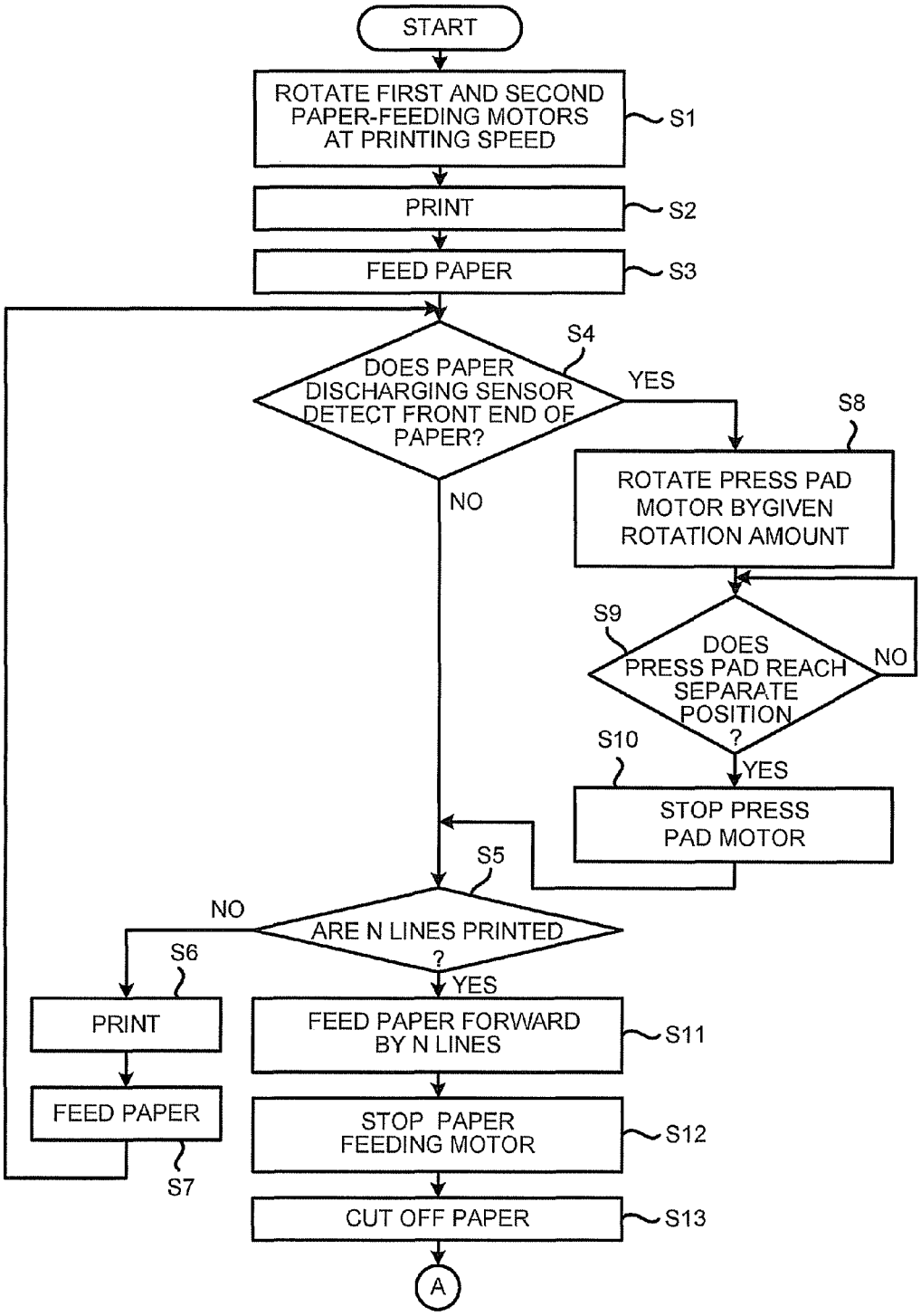
FIG. 16 is a flow chart showing an example of the operations implemented by the image forming apparatus.

Operations implemented by the image forming apparatus A having the structure above are described in detail below with reference to the sectional views of FIG. 1, FIG. 7-FIG. 15 and the flow charts of FIG. 16-FIG. 18. Here, the operations implemented by the image forming apparatus A from which the printing function is eliminated are those implemented by the paper discharging apparatus.

The paper P taken from the rolled paper 1 is conveyed to the conveyance path L under the control of the control unit 20, and the feeding motor 34 is rotated clockwise at a speed equal to the printing speed of the thermal printing head 2, that is, a speed of the platen motor 32 (Act S1). In this way, the first feeding roller 5 and the second feeding roller 7 rotate at the same speed with the platen roller 3.

The control unit 20 drives the thermal printing head 2 to print, for example, one line (one content line) on the paper P (Act S2). The paper P is fed forward by one line after one line is printed (Act S3).

The control unit 20 determines whether or not the front end of the paper P is detected by the paper discharging sensor 12 (Act S4). If the paper discharging sensor 12 does not detect the front end of the paper P (Act S4: No), the control unit 20 determines whether or not print of N (N is a natural number) lines are completed (Act S5). It should be noted that N refers to the number of total print-lines for the print job of the current processed subject.

If N lines are not all printed (Act S5: No), the control unit 20 drives the thermal printing head 2 to print, for example, one line, on the paper P (Act S6), and feeds the paper P forward by an amount corresponding to the one line after the line is printed (Act S7), and then returns to execute Act S4.

Figure 7:
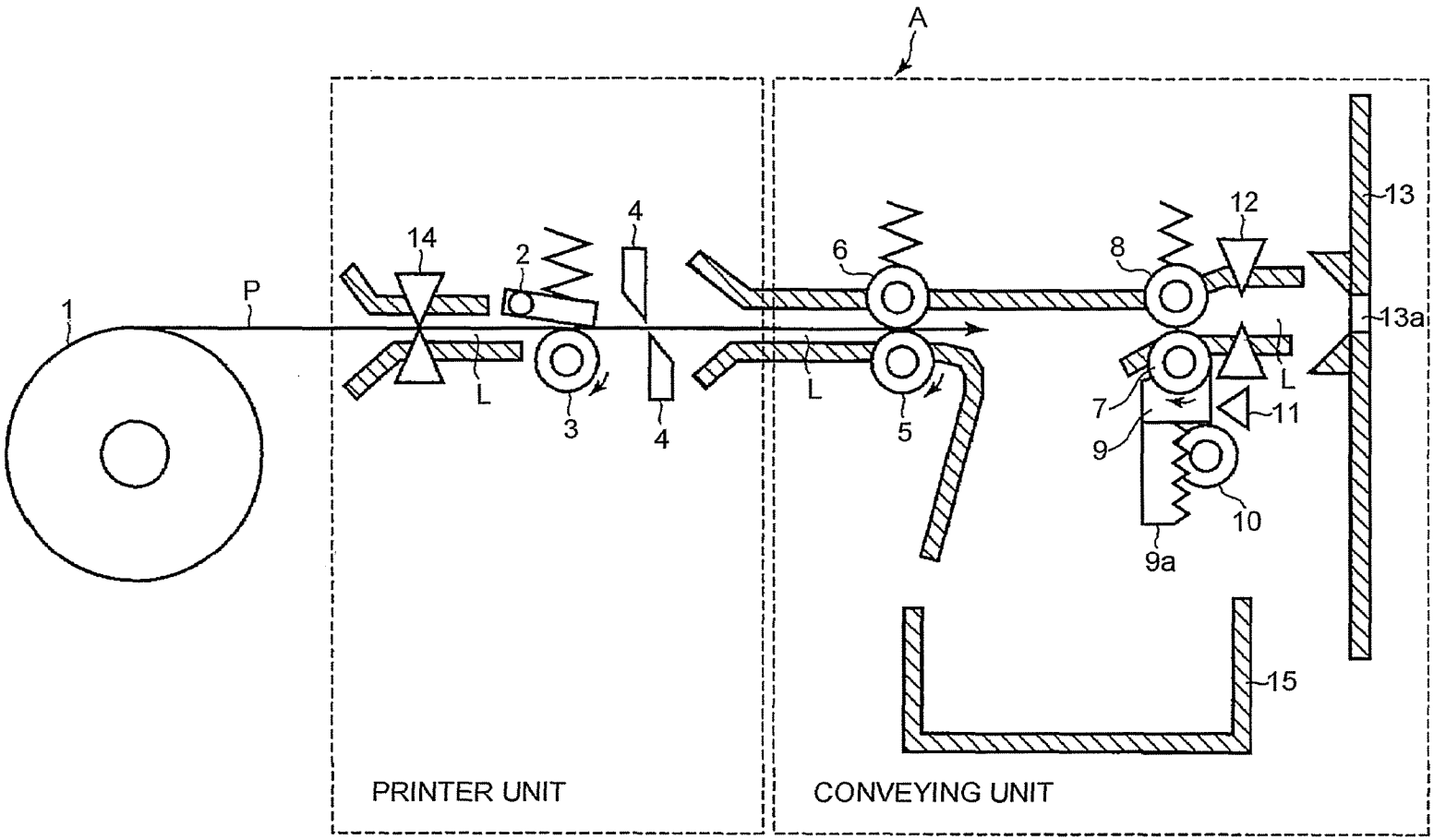
FIG. 7 is a sectional view showing the image forming apparatus in which printing is performed on a paper.
Figure 8:
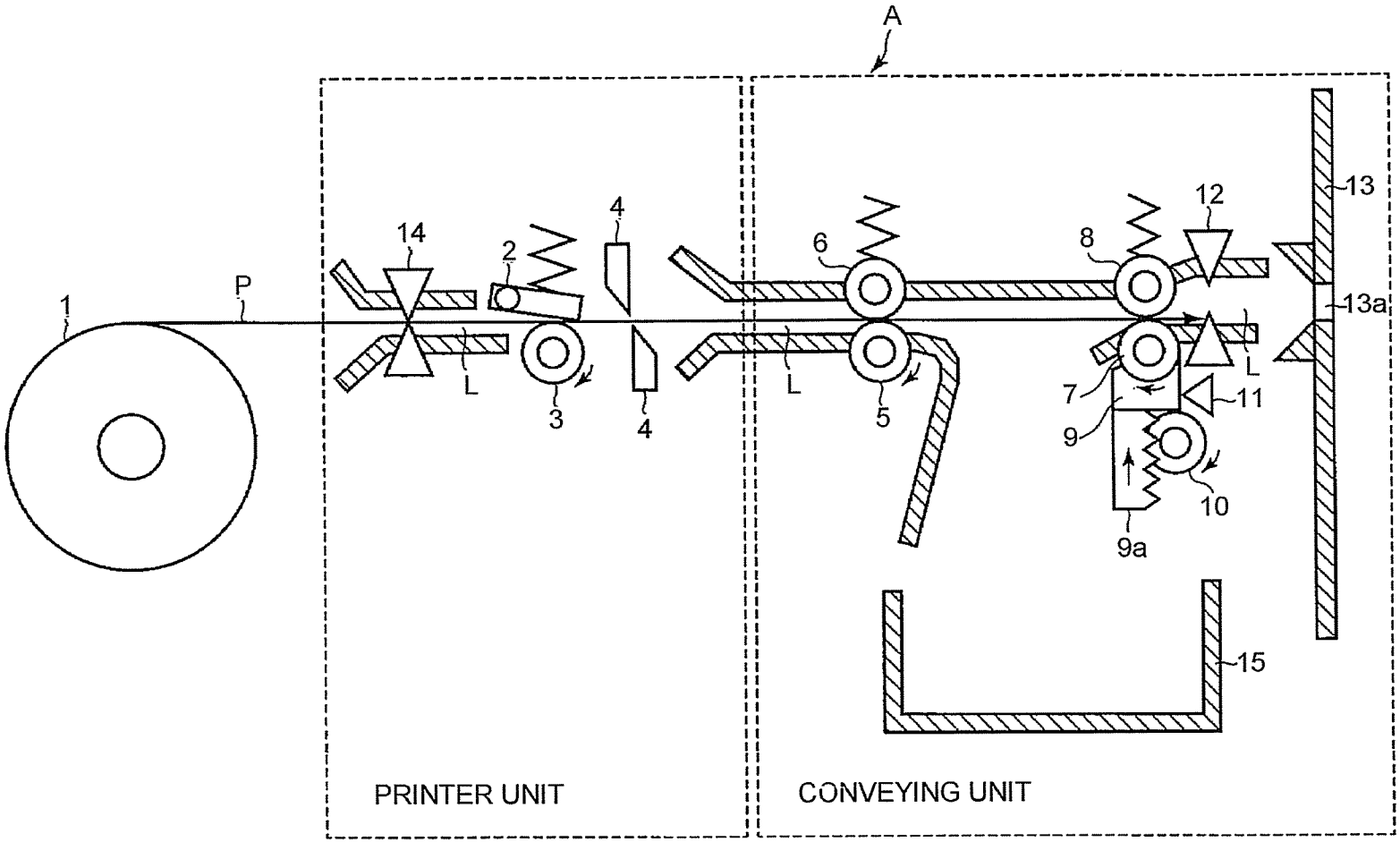
FIG. 8 is a sectional view showing the image forming apparatus in which a printed paper is moved.

The paper P is conveyed to the discharge port 13A along the conveyance path L while Acts S4-S7 are carried out repeatedly, as shown in FIG. 7. The front end of the paper P is detected by the paper discharging sensor 12 (Act S4: Yes) when the front end of the paper P reaches the position of the same sensor 12, as shown in FIG. 8. At this time, the control unit 20 rotates the press pad motor 35 clockwise to lift the press pad 9 (Act S8) and determines whether or not the press pad 9 reaches the separate position (Act S9). This determination may be carried out based on, for example, the output of the press pad sensor 11. Or, the rotation amount of the press pad motor 35 needed for lifting the press pad 9 from the standby position to the separate position is obtained beforehand and then the control unit 20 may determine that the press pad 9 reaches the separate position if the actual amount of the clockwise rotation of the press pad motor 35 comes to the rotation amount that is obtained previously. If it is determined that the press pad 9 reaches the separate position (Act S9: Yes), the control unit 20 stops the press pad motor 35 (Act S10), and then executes Act S5 thereafter.

Figure 9:
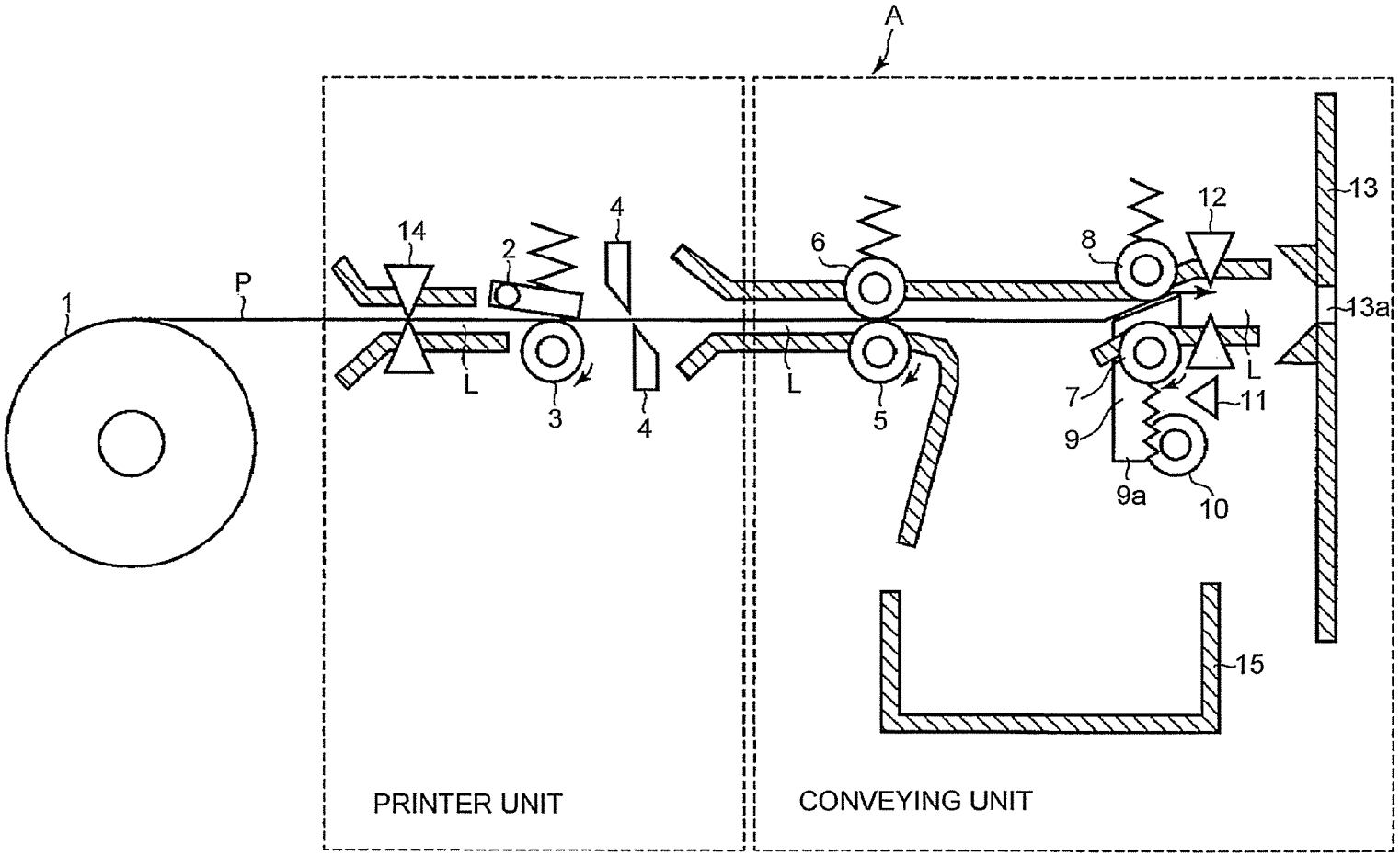
FIG. 9 is a sectional view showing the image forming apparatus in which the press pad is lifted.

After Acts S8-S10 are executed, the second pinch roller 8 is lifted by the press pad 9 and is separated from the second feeding roller 7, as shown in FIG. 9. In addition, the paper P is clamped or pinched by the upper surface 9C of the press pad 9 and the second pinch roller 8.

Figure 10:
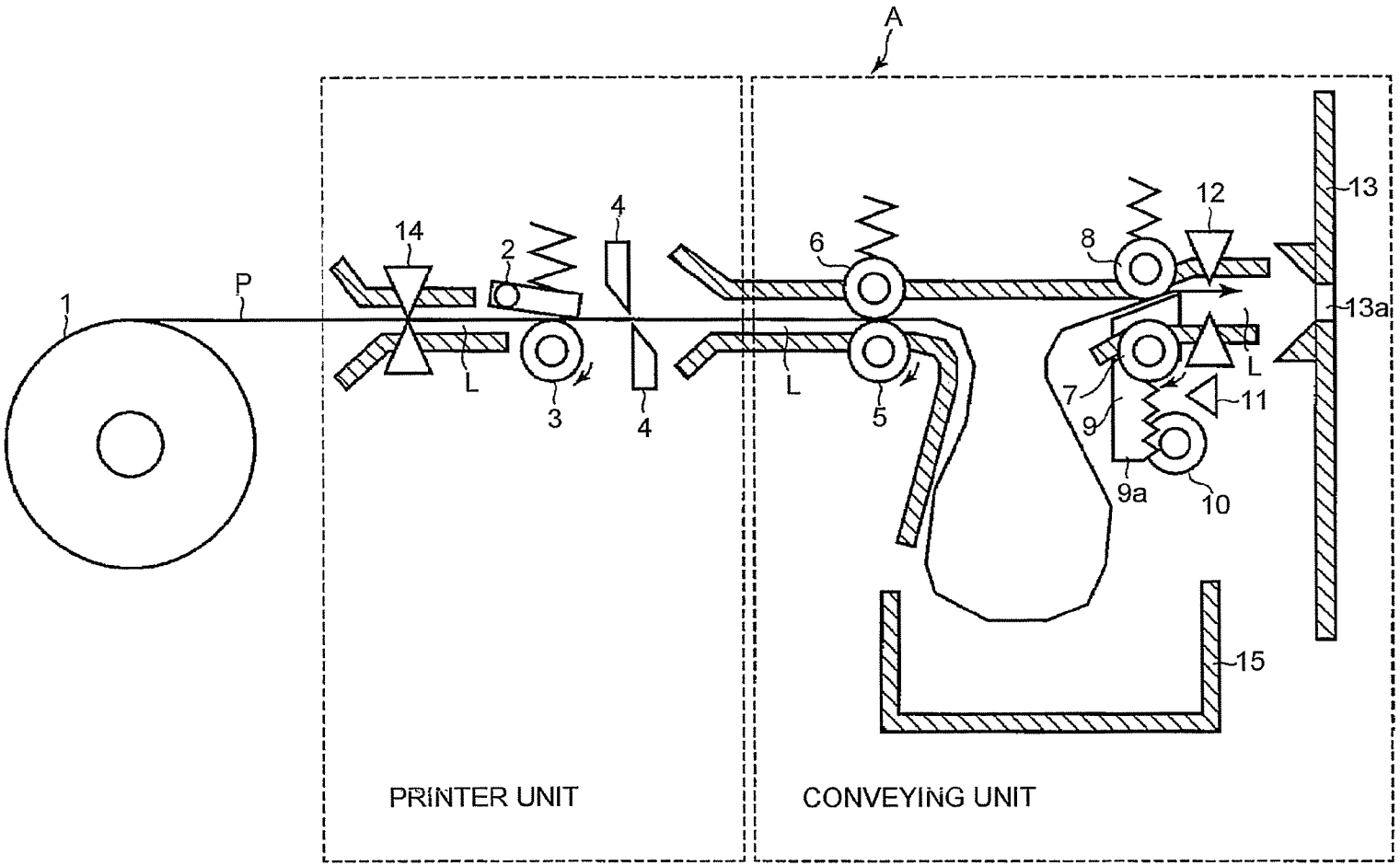
FIG. 10 is a sectional view showing the image forming apparatus in which a paper is bent.

When Acts S4-S7 are executed repeatedly after the press pad 9 is lifted, the paper P is continuously conveyed to the discharge port 13A by the first feeding roller 5, but the paper P is bent as shown in FIG. 10, because a resistance force is generated at the clamped part of the paper P by the second pinch roller 8 and the press pad 9.

Especially, since the upper surface 9C of the press pad 9 is inclined in this embodiment, the paper P is curved along the inclined surface as the paper P is fed by the first feeding roller 5 and the first pinch roller 6, consequentially, the paper P is smoothly bent towards the opened part below the conveyance path L.

Thus, because of the paper P being bent, the paper P is not exposed to the outside from the discharge port 13A during printing.

Printing of N lines on the paper P is finished (Act S5: Yes) if Acts S4-S7 are executed repeatedly while the paper P is bent. At this time, the control unit 20 feeds the paper P by a required length M (M is a natural number) using the paper-pressing roller 3 and the first feeding roller 5 (Act S11) and stops the platen motor 32 and the feeding motor 34 (Act S12). In addition, the control unit 20 rotates the cutter motor 33 clockwise to drive the cutter 4 and thus the paper P is cut off (Act S13).

Figure 17:
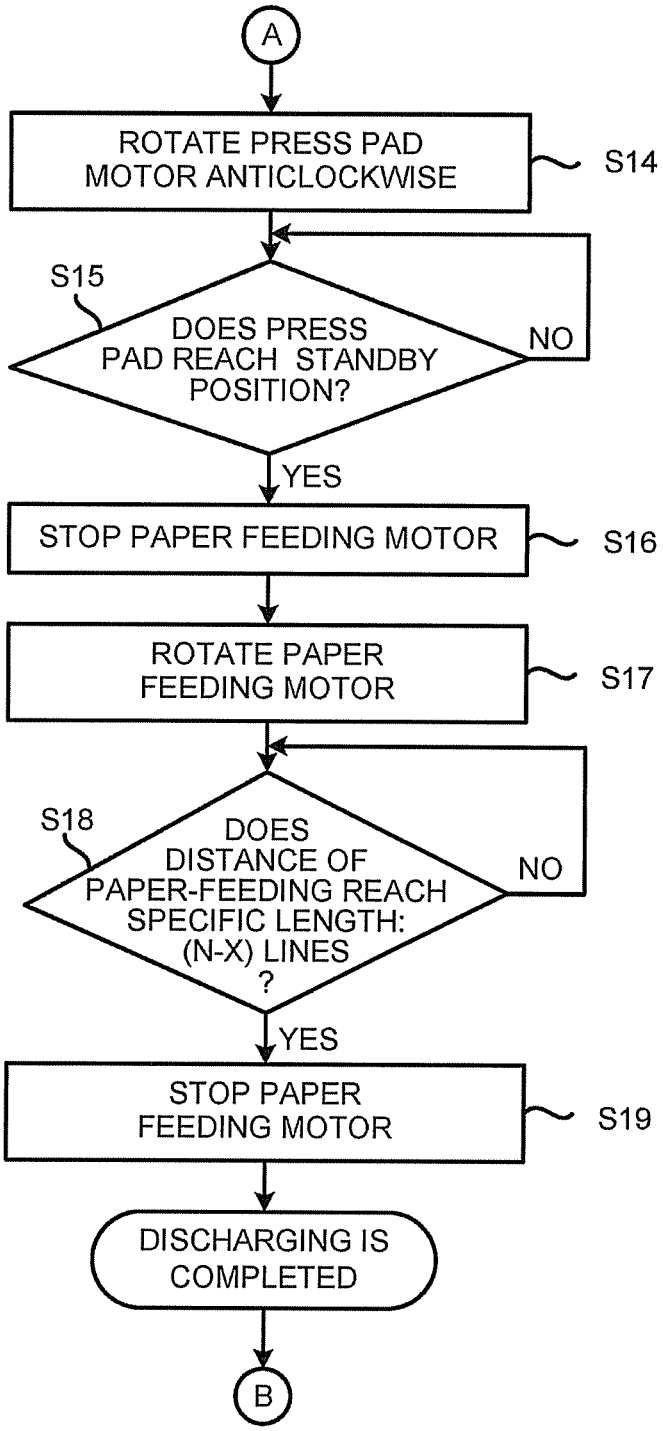
FIG. 17 is a flow chart showing an example of the operations implemented by the image forming apparatus.

Explanation of the operation is continued referring to the flow chart in FIG. 17. After the paper P is cut off in Act S13, the control unit 20 rotates the press pad motor 35 anticlockwise to lower the press pad 9 (Act S14) and determines whether or not the press pad 9 reaches the standby position (Act S15). Similar to the situation described in Act S9, this determination may be carried out based on, for example, the output of the press pad sensor 11, or the rotation amount of the press pad 35 needed for lowering the press pad 9 from the separate position to the standby position is obtained beforehand and then the control unit 20 may determine that the press pad 9 reaches the standby position if the actual amount of the anticlockwise rotation of the press pad motor 35 comes to the rotation amount that is obtained previously. After it is determined that the press pad 9 reaches the standby position (Act S15: Yes), the control unit 20 stops the press pad motor 35 (Act S16).

Figure 11:
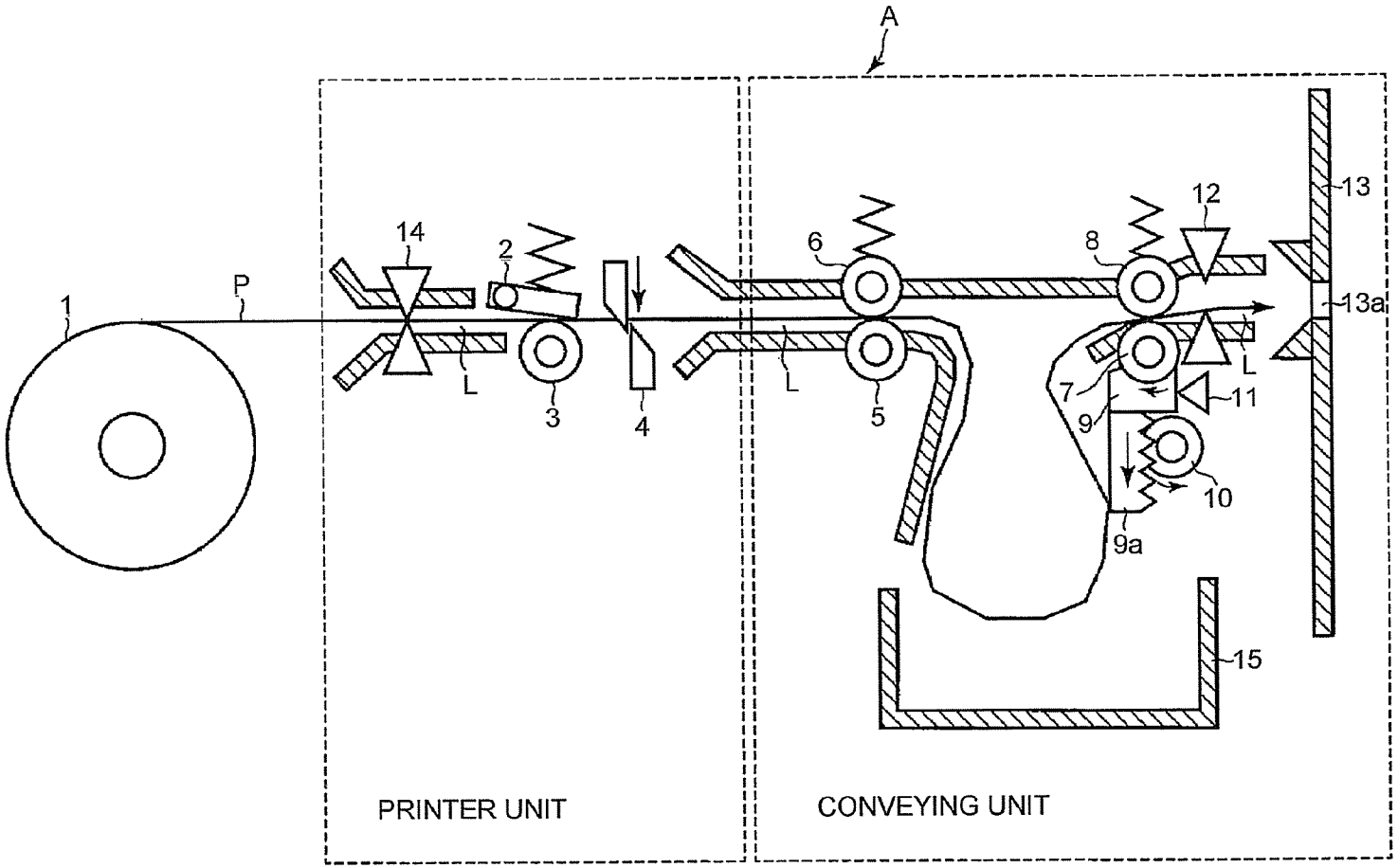
FIG. 11 is a sectional view showing the image forming apparatus in which the press pad is lowered.
Figure 12:
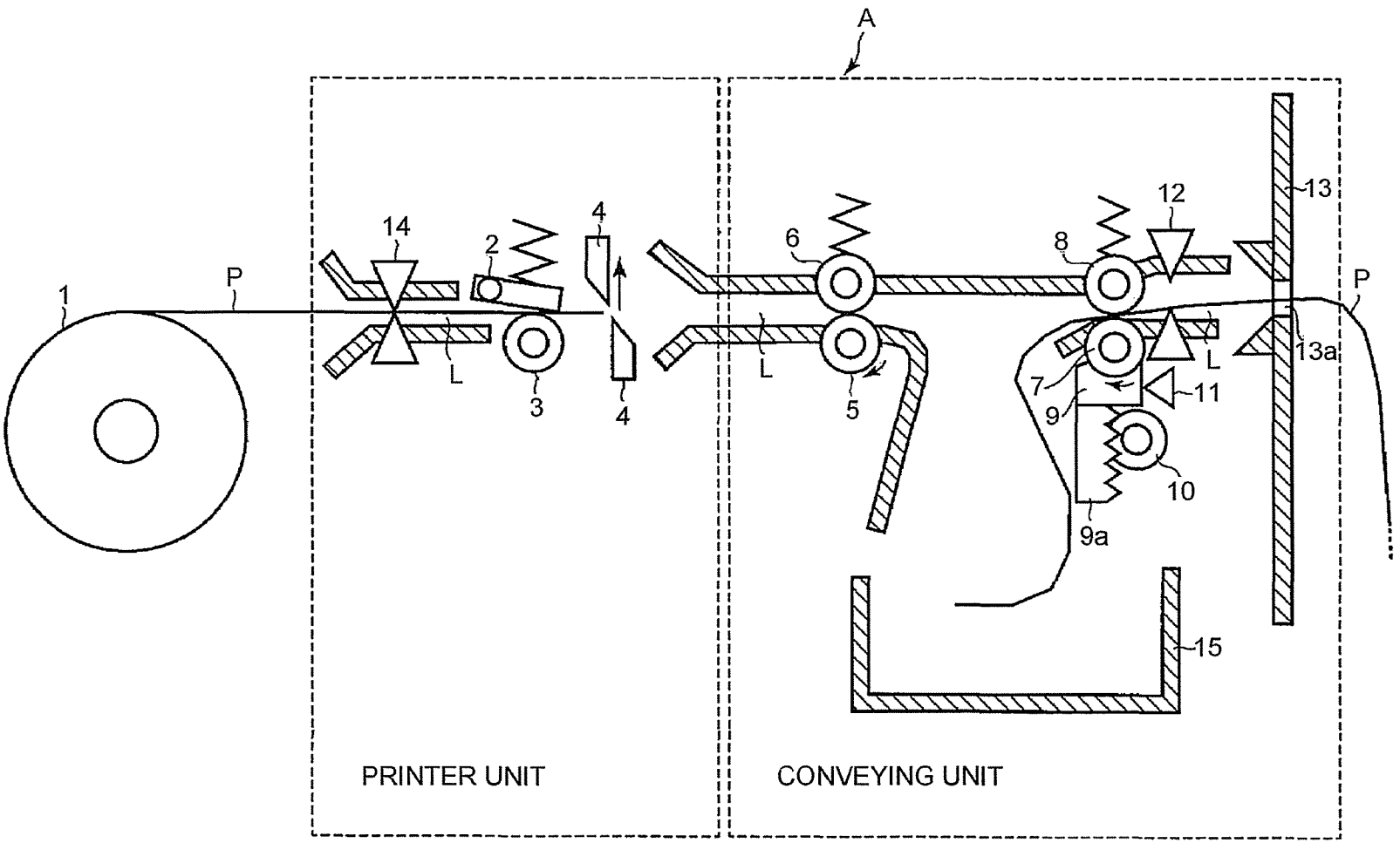
FIG. 12 is a sectional view showing the image forming apparatus from which a cut paper is being discharged.

After Acts S14-S16 are executed, the second pinch roller 8 returns to the original position, and the paper P is clamped by the second feeding roller 7 and the second pinch roller 8, as shown in FIG. 11. In this case, the control unit 20 rotates the feeding motor 34 clockwise (Act S17) and determines whether or not the paper P is fed forward by N-X lines (X is a natural number smaller than N) (Act S18). The feeding motor 34 is continuously rotated clockwise until the paper P is fed forward by N-X lines so that the paper P that is cut off comes to be exposed or discharged from the discharge port 13A, as shown in FIG. 12.

Figure 13:
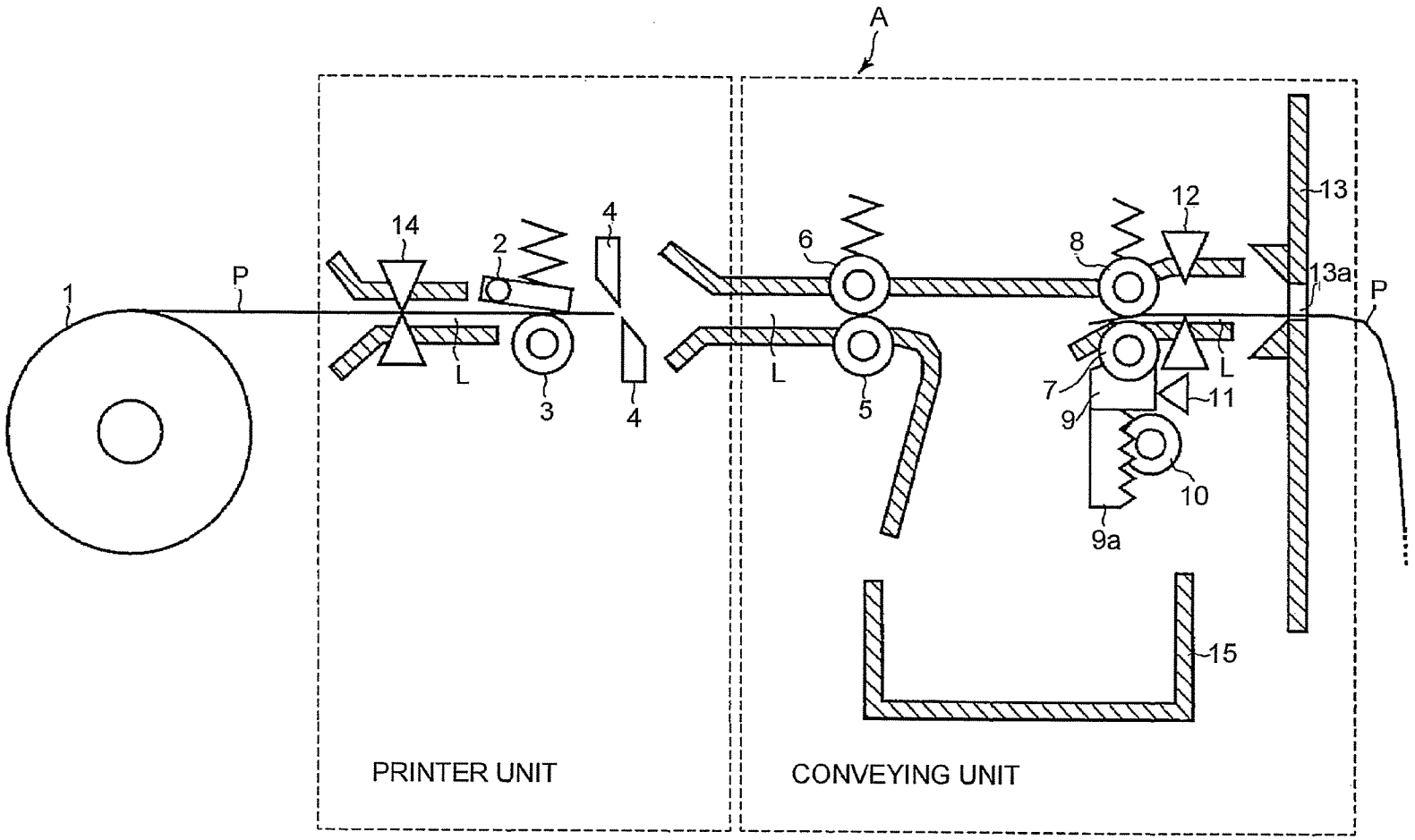
FIG. 13 is a sectional view showing the image forming apparatus entering into a standby state after the paper discharging is completed.

The control unit 20 stops the feeding motor 34 (Act S19) after the paper P is fed forward by N-X lines (Act S18: Yes). Then, the second feeding roller 7 stops rotating, and the discharging of the paper P is completed. At this time, as shown in FIG. 13, the printed paper P (for example, receipt) stops such that a part (front end part) of the printed paper P is hung down from the discharge port 13A while the other part is clamped still by the second feeding roller 7 and the second pinch roller 8. In this state, the user can take out the printed paper P. Besides, the X lines may be determined depending on the distances from the second feeding roller 7 and the second pinch roller 8 to the discharge port 13A so that at least the front end of the printed paper P is exposed from the discharge port 13A in a state that the printed paper P is clamped by the second feeding roller 7 and the second pinch roller 8.

Figure 18:
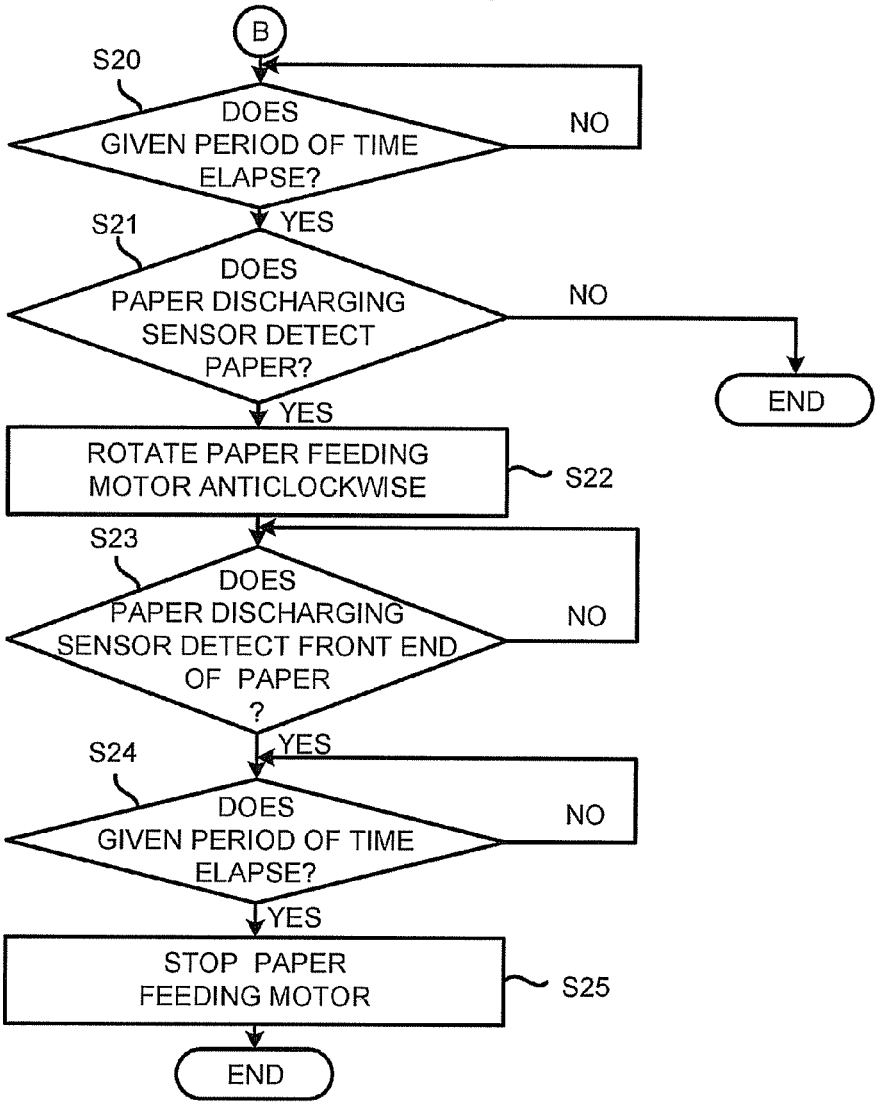
FIG. 18 is a flow chart showing an example of the operations implemented by the image forming apparatus.

Explanation of the operation is further continued referring to the flow chart in FIG. 18. After the printed paper P is discharged, the control unit 20 determines whether or not a given period of time (e.g. 1 min.) elapses from the completion of the discharging (Act S20). If the given period of time elapses (Act S20: Yes), the control unit 20 determines whether or not the paper P is detected by the paper discharging sensor 12 (Act S21). If the paper P is not detected by the paper discharging sensor 12 (Act S21: No), the control unit 20 determines that the paper P is taken away by the user and ends the series of processing for the printing task based on the determination result.

On the other hand, if the paper P is detected by the paper discharging sensor 12 (Act S21: Yes), then the control unit 20 withdraws the paper P into the housing. That is, the control unit 20 rotates the feeding motor 34 anticlockwise (Act S22) and waits for the paper discharging sensor 12 to detect the front end of the paper P (Act S23). At this time, as shown in FIG. 14, the second feeding roller 7 rotates anticlockwise to draw back the printed paper P into the housing.

If the front end of the paper P is detected by the paper discharging sensor 12 (Act S23: Yes), then the control unit 20 waits for a period of time required that the front end of the paper P fully passes the position where the second feeding roller 8 is contacted with the second pinch roller 8 (Act S24) and stops the feeding motor 34 (Act S25) if the required period of time passes (Act S24: Yes). Then, the withdrawal of the paper P is ended, and as shown in FIG. 15, the printed paper P is withdrawn to the capture bin 15 after sheering from the conveyance path 1.

The image forming apparatus (paper discharging apparatus) A according to this embodiment moves the upper surface 9C of the press pad 9 to the separate position to separate the second feeding roller 7 from the second pinch roller 8, and thus the paper P is clamped between the second pinch roller 8 and the upper surface 9C of the press pad 9. Under this state, the paper P is further conveyed by the first feed roller 5 and the first pinch roller 6 so as to curve the paper P. After that, the upper surface 9C of the press pad 9 is moved to the standby position so that the paper P is clamped by the second feeding roller 7 and the second pinch roller 8, and then the paper P is discharged from the conveyance path L by the rotation of the second feeding roller 7 while the paper P is clamped.

According to this structure, the timing for discharging the printed paper P from the discharge port 13A can be adjusted. Thus, as described in this embodiment, the press pad 9 is moved to and located at the separate position until the printing is completed and then returned to the standby position after the printing is completed. By the operation described, the paper P is not exposed from the discharge port 13A prior to the completion of the printing and thereby preventing the paper P from being taken away by the user while the paper P is being printed.

Since the upper surface 9C of the press pad 9 is inclined with respect to the paper P conveying direction of the first feeding roller 5 and the first pinch roller 6, the paper P can be bent smoothly.

Even the paper P discharged from but left at the discharge port 13A can be automatically collected into the housing after a given period of time passes. Therefore, the user is not required to collect the paper P left at the discharge port 13A, manually.

Since the paper P is collected through the anticlockwise rotation of the feeding motor 34, there is no need to arrange a specific mechanism.

Apart from those mentioned above, the apparatus described above may achieve other appropriate effects.

[Modifications]

The apparatus disclosed in this embodiment may be embodied by modifying the structural components appropriately when in application. There exist, for example, the following specific modifications:

(1) In the embodiment above, the press pad 9 is exemplarily moved by the rack component 9A and the pinion 10; however, the press pad 9 may also be moved by other mechanisms, for instance, the press pad 9 may be moved by a cam mechanism between the standby position and the separate position.

Figure 19:
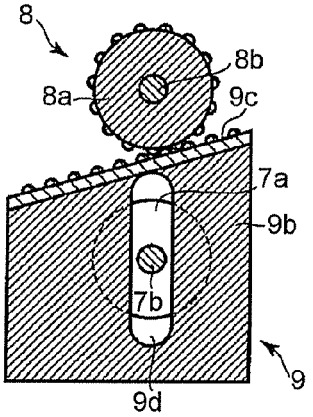
FIG. 19 is a schematic diagram showing a modification of the press pad.

(2) In the structure described in the embodiment above, even clamped by the second pinch roller 8 and the upper surface 9C, there is a possibility that the paper P may be fed to the downstream side as the second pinch roller 8 may be rotated by the conveying force of the first feeding roller 5. The coping measure is to rough the surface of the second pinch roller 8 and the upper surface 9C of the press pad 9, as shown in FIG. 19, so that when the upper surface 90 is contacted with the second pinch roller 8 through the paper P, the roughed surface of the second pinch roller 8 is subjected to a counter force from the roughed surface of the press pad 9 to prevent the second pinch roller 8 from rotating.

Figure 20:
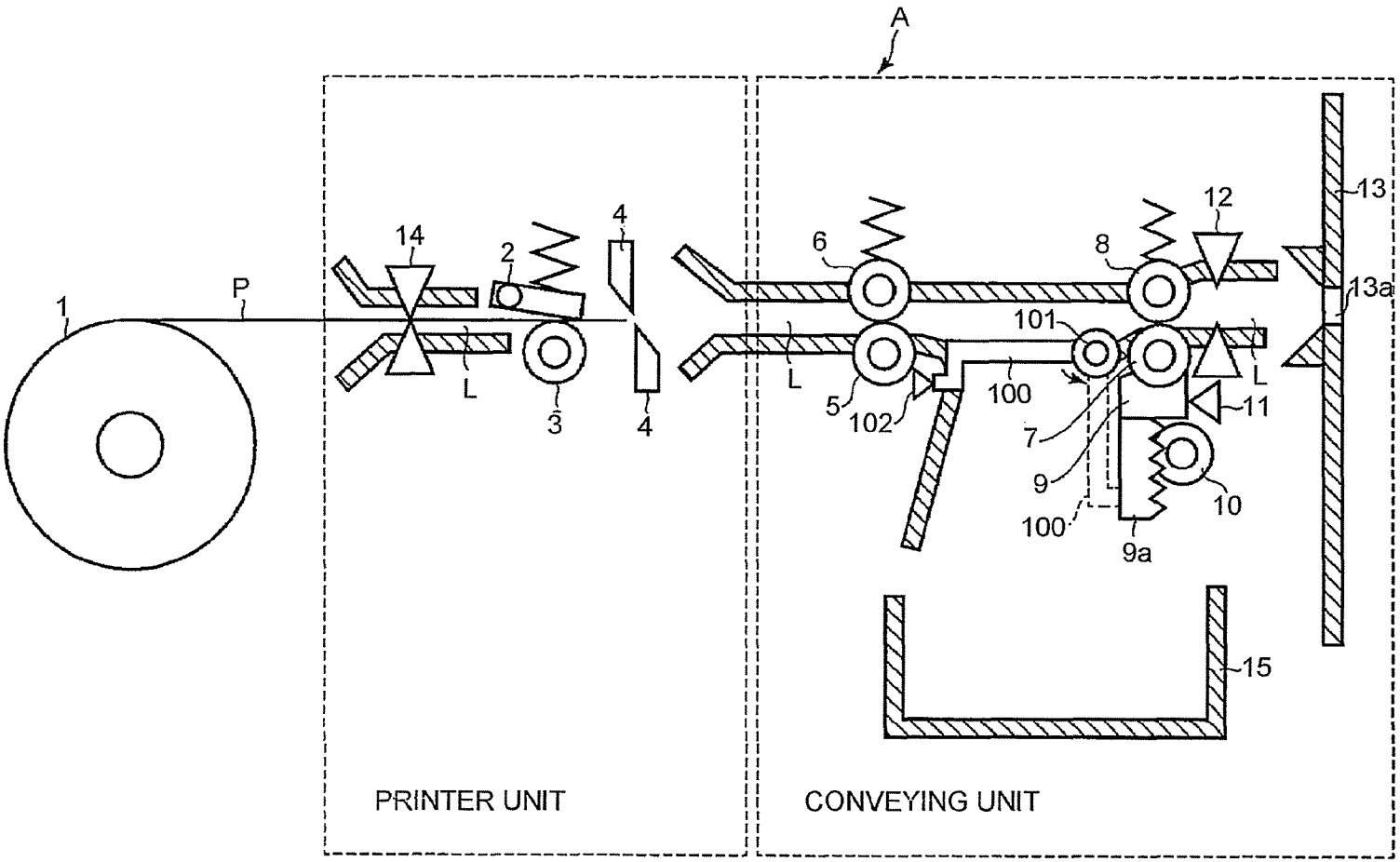
FIG. 20 is a sectional view showing a structural example of a modification of the image forming apparatus.

(3) In addition, the opened part of the conveyance path L arranged between the first feeding roller 5 and the first pinch roller 6 as well as between the second feeding roller 7 and the second pinch roller 8 may also be formed in open-close manner. FIG. 20 shows an example of the image forming apparatus A in which the opened part is changed to an open-close part. In this example, a flapper 100 for opening or closing the opened part, a rotation shaft 101 for rotating the flapper 100, and a flapper sensor 102 for detecting whether or not the flapper 100 is at the standby position (starting position) are provided. The rotation shaft 101 is driven by a flapper motor connected with the control unit 20.

If the image forming apparatus is structured like this, the flapper motor is rotated clockwise when the press pad 9 is lifted to the separate position, for example, in Acts S8-S10 until the flapper 100 is fully opened. When the flapper 100 is rotated clockwise to the position indicated by the dotted lines shown in FIG. 20, the opened part of the conveyance path L is opened to secure a space for bending the paper P. Then, the flapper motor is rotated anticlockwise when the press pad 9 is lowered to the standby position in Acts S14-S18 until the flapper sensor 102 detects the flapper 100. In such a manner, the opened part of the conveyance path L is closed by the flapper 100.

As a result, the space of the conveyance path L is enlarged when necessary, and the paper P is conveyed smoothly when there is no need to bend the paper P.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. A method for discharging the paper by a paper discharging apparatus which includes a paper conveyance path; a first conveying unit configured to convey a paper along the conveyance path; a second conveying unit including a pinch roller and a feeding roller that are arranged closer to the downstream side than the first conveying unit in the paper conveying direction, the pinch roller and the feeding roller clamping the paper therebetween and conveying the paper along the conveyance path; and a movable mechanism, including a surface part having a specified shape, moving the surface part between a first position that the surface part is not contacted with the pinch roller and a second position that the surface part is contacted with the pinch roller through the paper and pushes the pinch roller until the pinch roller is separated from the feeding roller; the paper discharging method comprising:

moving the surface part to the second position by the movable mechanism to clamp the paper by the pinch roller and the surface part using a control unit, bending the paper through conveying the paper by the first conveying unit, then moving the surface part to the first position by the movable mechanism to clamp the paper by the pinch roller and the feeding roller, and discharging the paper from the conveyance path by rotating the feeding roller, and collecting the paper into the housing of the paper discharging apparatus if a given period of time elapses in a state that the paper is at least partially exposed from a discharge port arranged on the housing as determined by the control unit.

2. The paper discharging method according to claim 1, further comprising:

stopping the feeding roller, when discharging the paper along the conveyance path, in a state that one part of the paper is exposed from the discharge port while the other part of the paper is clamped by the pinch roller and the feeding roller, then rotating the feeding roller so as to convey the paper in the direction opposite to the conveying direction and collecting the paper inside the housing if the given period of time elapses.

3. An image forming method for forming image by an image forming apparatus which includes a paper conveyance path; a first conveying unit configured to convey a paper along the conveyance path; a second conveying unit including a pinch roller and a feeding roller that are arranged closer to the downstream side of the paper conveying direction than the first conveying unit, the pinch roller and the feeding roller clamping the paper therebetween and conveying the paper along the conveyance path; a printer unit configured to print on the paper; and a movable mechanism, including a surface part having a specified shape, moving the surface part between a first position that the surface part is not contacted with the pinch roller and a second position that the surface part is contacted with the pinch roller through the paper and pushes the pinch roller until the pinch roller is separated from the feeding roller; the forming method, comprising:

moving the surface part to the second position by the movable mechanism to clamp the paper by the pinch roller and the surface part using a control unit, bending the paper through conveying the paper by the first conveying unit, then moving the surface part to the first position by the movable mechanism to clamp the paper by the pinch roller and the feeding roller, and discharging the paper from the conveyance path by rotating the feeding roller, and collecting the paper into the housing of the paper discharging apparatus if a given period of time elapses in a state that the paper is at least partially exposed from a discharge port arranged on the housing as determined by the control unit.

4. The image forming method according to claim 3, further comprising:

stopping the feeding roller, when discharging the paper along the conveyance path, in a state that one part of the paper is exposed from the discharge port while the other part of the paper is clamped by the pinch roller and the feeding roller, then rotating the feeding roller so as to convey the paper in the direction opposite to the conveying direction and collecting the paper inside the housing if the given period of time elapses.

5. The image forming method according to claim 3, further comprising:

moving the surface part to the first position by the movable mechanism and clamping the paper by the pinch roller and the feeding roller after the paper is printed by the printer unit and cut by the cutter, and discharging the paper from the conveyance path by rotating the feeding roller.

6. The image forming method according to claim 3, further comprising:

moving the surface part to the second position by the movable mechanism when the sensor, which is arranged closer to the downstream side than the pinch roller and the feeding roller in the paper conveying direction, detects the paper.

* * * * *